US007490680B2

(12) United States Patent
Medd et al.

(10) Patent No.: US 7,490,680 B2
(45) **Date of Patent: *Feb. 17, 2009**

(54) PROCESS AND SYSTEM FOR DRILLING AND LINING A BORE HOLE

(75) Inventors: Morris Medd, North Bay (CA); Mike Kelly, Callander (CA); Dan Kelly, North Bay (CA)

(73) Assignee: J. S. Redpath Ltd., North Bay (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/733,424

(22) Filed: Apr. 10, 2007

(65) Prior Publication Data

US 2007/0175668 A1 Aug. 2, 2007

Related U.S. Application Data

(62) Division of application No. 10/766,199, filed on Jan. 27, 2004, now Pat. No. 7,219,750.

(60) Provisional application No. 60/442,505, filed on Jan. 27, 2003.

(51) Int. Cl.
*E21B 7/28* (2006.01)
*E21B 11/00* (2006.01)

(52) U.S. Cl. ..... 175/53; 175/57; 175/171

(58) Field of Classification Search ..... 175/393, 175/171, 263, 424, 320, 315, 87, 53, 344, 175/57; 166/65, 378, 380, 222, 223; 405/150.2, 405/146

See application file for complete search history.

(56) References Cited

U.S. PATENT DOCUMENTS 2,387,002 A 10/1945 Bannister
3,083,765 A 4/1963 Kammerer
3,220,494 A 11/1965 Cannon et al.

(Continued)

FOREIGN PATENT DOCUMENTS

CA 1251475 A 3/1989

(Continued)

OTHER PUBLICATIONS

International Search Report from PCT/CA2004/000101.

*Primary Examiner*—Kenneth Thompson
(74) *Attorney, Agent, or Firm*—John R. S. Orange; Brett J. Slaney; Blake, Cassels & Graydon LLP

(57) ABSTRACT

An apparatus is provided for the drilling of a borehole and its simultaneous lining with cement or the like by the same apparatus. The apparatus comprises a combination spray bead and reamer head, a means to drive the reamer head through a borehole and a means for delivering cement to the spray head. Cement is fed to a rotatable spray disc or arms of the spray head, which is arranged to distribute the cement substantially evenly over the internal surface of the borehole created by the reamer head. The apparatus uses lined drill rods, as well as a lined reamer core with a double walled plastic tube. An air transfer assembly is used to connect an internal air source to an air passage contained in the plastic tube, such that the external air source remains stationary during rotation of the lined drill rods and attached reamer and spray beads.

13 Claims, 9 Drawing Sheets

U.S. PATENT DOCUMENTS

| | | | | |
|---|---|---|---|---|
| 3,664,441 | A | 5/1972 | Carey | |
| 3,935,910 | A * | 2/1976 | Gaudy et al. | 175/17 |
| 4,042,047 | A | 8/1977 | Dively et al. | |
| 4,784,223 | A * | 11/1988 | Worrall et al. | 166/287 |
| 4,793,736 | A | 12/1988 | Thompson et al. | |
| 5,456,552 | A | 10/1995 | Cherrington | |
| 6,533,036 | B1 * | 3/2003 | Baret et al. | 166/290 |
| 7,231,977 | B2 * | 6/2007 | Keller | 166/292 |
| 2004/0149431 | A1 | 8/2004 | Wylie et al. | |
| 2005/0004416 | A1 | 1/2005 | Okutsu et al. | |
| 2006/0196663 | A1 * | 9/2006 | Keller | 166/285 |
| 2008/0053706 | A1 * | 3/2008 | Keller | 175/72 |

FOREIGN PATENT DOCUMENTS

| | | | |
|---|---|---|---|
| CA | 1308249 | C | 10/1992 |
| FR | 2526853 | A | 11/1983 |
| WO | WO 99/27192 | A1 | 6/1999 |

* cited by examiner

PROCESS AND SYSTEM FOR DRILLING AND LINING A BORE HOLE

CROSS-REFERENCE TO RELATED APPLICATIONS

This application is a divisional of U.S. patent application Ser. No. 10/766,199 filed on Jan. 27, 2004 now U.S. Pat. No. 7,219,750, which claims priority from U.S. Patent Application No. 60/442,505 filed on Jan. 27, 2003, the contents of both being incorporated herein by reference.

FIELD OF THE INVENTION

The present invention relates to a method and apparatus for raise bore drilling and lining of a borehole, more specifically to bore holes drilled for use in the mining industry.

DESCRIPTION OF THE PRIOR ART

Raise bore drilling has been used in the milling industry for many years and has been successful in virtually all types of rock. Modern raise bore drilling machines are capable of boring a pilot hole of up to 1000 meters and then reaming the pilot hole out to between 3 and 20 feet. Prior to the drilling of the pilot hole, information relating to the bore hole (i.e. location, start and end co-ordinates, size of hole, start-and-break-through mine levels, and the type of rock) are required to determine the size of raise drilling machine required, size of reamer, length of hole, and the size and number of drill rods required to complete the bore hole formation. Once this information is ascertained, the layout of the drilling apparatus is calculated and the drilling station is set up.

The first stage of borehole drilling involves the creation of a pilot hole. The piloting process generally begins by assembling a pilot bit, roller bit stabilizer, one or two ribbed stabilizers and loading the assembly into the raise drill. On drilling, the hole is flushed with a fluid medium, typically water, to flush cuttings away from the pilot bit. The resultant slurry is forced up through the drilled hole around the outside of the drill and is piped away from the raise drill by means known to one skilled in the art. Typically, a new drill rod is added after each live feet of drilling is completed, however lesser drill rod lengths are also used. The pilot process continues until the pilot bit breaks through at a lower level of the mine.

The second stage involves the replacement of the pilot bit with a reamer to enlarge a portion of the pilot hole. Generally the reamer is positioned such that it is adjacent to the surface of the rock face and is loaded to the tension required to force the reamer cutters into the rock during rotation of the drill string. Typically, after each drill rod length of reaming is complete, a drill rod is removed and the process is repeated until the reamer is immediately below the raise drill set up rail. At this point the reamer is removed and the borehole is completed.

The third stage involves lining of the borehole with a material such as cement to guard against the erosion and potential collapse of the borehole walls. Once the reamer and drilling equipment are removed, a lining delivery equipment is set up. Typically, this process involves the use of a separate device under remote control in order to avoid an operator having to descend into the boreholes. Several systems exist for the application of this lining, such as preformed liner sleeves, shuttering, and a spray-on apparatus. However, each is an independent system to the apparatus used for the drilling of the borehole. This arrangement has disadvantages in that set-up time is required for both the drilling apparatus and lining delivery equipment. Accordingly, the use of two separate and independent systems in the creation of a borehole, one for drilling and one for lining, can require two crews and two sets of equipment. This method can be particularly time consuming and costly.

In the art, Canadian Patent 1,308,249 describes a process for the lining or boreholes involving an apparatus for the remote spraying of cement on the walls of a bore hole. This patent focuses solely on the lining of the borehole once the borehole has been created. Canadian Patent 1,251,475 teaches a raise bore mining method; however, the patent does not discuss the lining of the bore itself.

It is an object of the present invention to provide a drilling system and method to obviate or mitigate at least some of the above-mentioned disadvantages.

SUMMARY OF THE INVENTION

The following describes a raise bore drilling and lining apparatus comprising a raise boring drill for boring a raise into a pilot hole, using a drill string to create a bore hole; a reamer head affixed to one end of the drill string where the drill string and reamer have a passage defined there through which is generally coaxial with the drill string; and a spreader assembly for distributing a liner material on the wall of the bore hole, where the spreader assembly is affixed to the reamer at an end opposite to the drill string.

The combined liner and drill apparatus enables a single system to both line add drill the bore hole and help improve the efficiency of the overall process. The reamer remains in the borehole during the distribution of the liner material on the wall of the borehole. Further, the reamer and spreader assembly is used to help provide a uniform thickness of liner material to the wall of the borehole.

In one aspect, there is provided a reamer assembly for use with a raise bore drilling and lining apparatus, the reamer assembly including a reamer head, a spreader assembly secured to the reamer head for movement therewith and for distributing a liner material on the wall of the bore hole during operation thereof, the spreader assembly comprising a plate rotatable relative to the reamer head; and a material supply connected to the spreader assembly to deliver material thereto.

In another aspect, there is provided a drill rod comprising an outer casing, a connection at opposite ends of the rod to permit a plurality of the drill rod to be connected in seriatim to form a drill string; and a liner located within the casing, the liner having a plurality of concentric walls defining a series of fluid passageways between successive ones of the walls to convey fluid axially within the rod between the opposite ends.

In yet another aspect, there is provided a reamer assembly for use with a raise bore drilling and lining apparatus, the reamer assembly including a reamer head; a spreader assembly secured to the reamer head for movement therewith and for distributing a liner material on the wall of the bore hole during operation thereof, the spreader assembly independently rotatable of the reamer head; and a material supply connected to the spreader assembly to deliver material thereto.

Other aspects of the invention can include a double walled drill rod and a spreader assembly.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
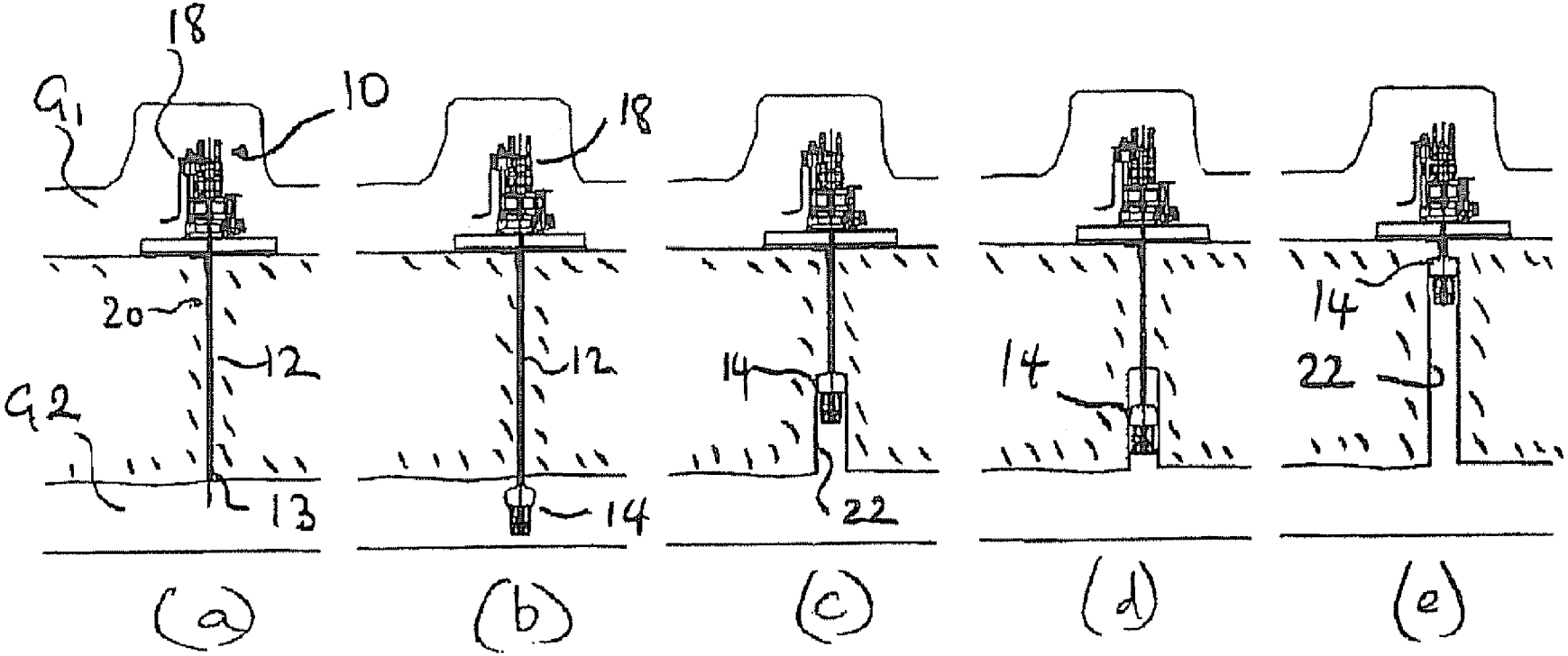
FIG. 1 is a schematic representation of the sequence of steps used to create a raise bore.

Referring firstly to FIG. 1 raise bore drilling apparatus generally indicated at 10 is located in an upper gallery G1 of a mine at a position in which a vertical bore interconnecting the upper gallery G1 and lower gallery G2 is required. The raise bore drilling apparatus 10 includes a raise bore drill 18 to which is connected a drill string 12. The drill string 12 is formed from interconnected drill rods 36 to which is connected a tool 13.

Figure 2:
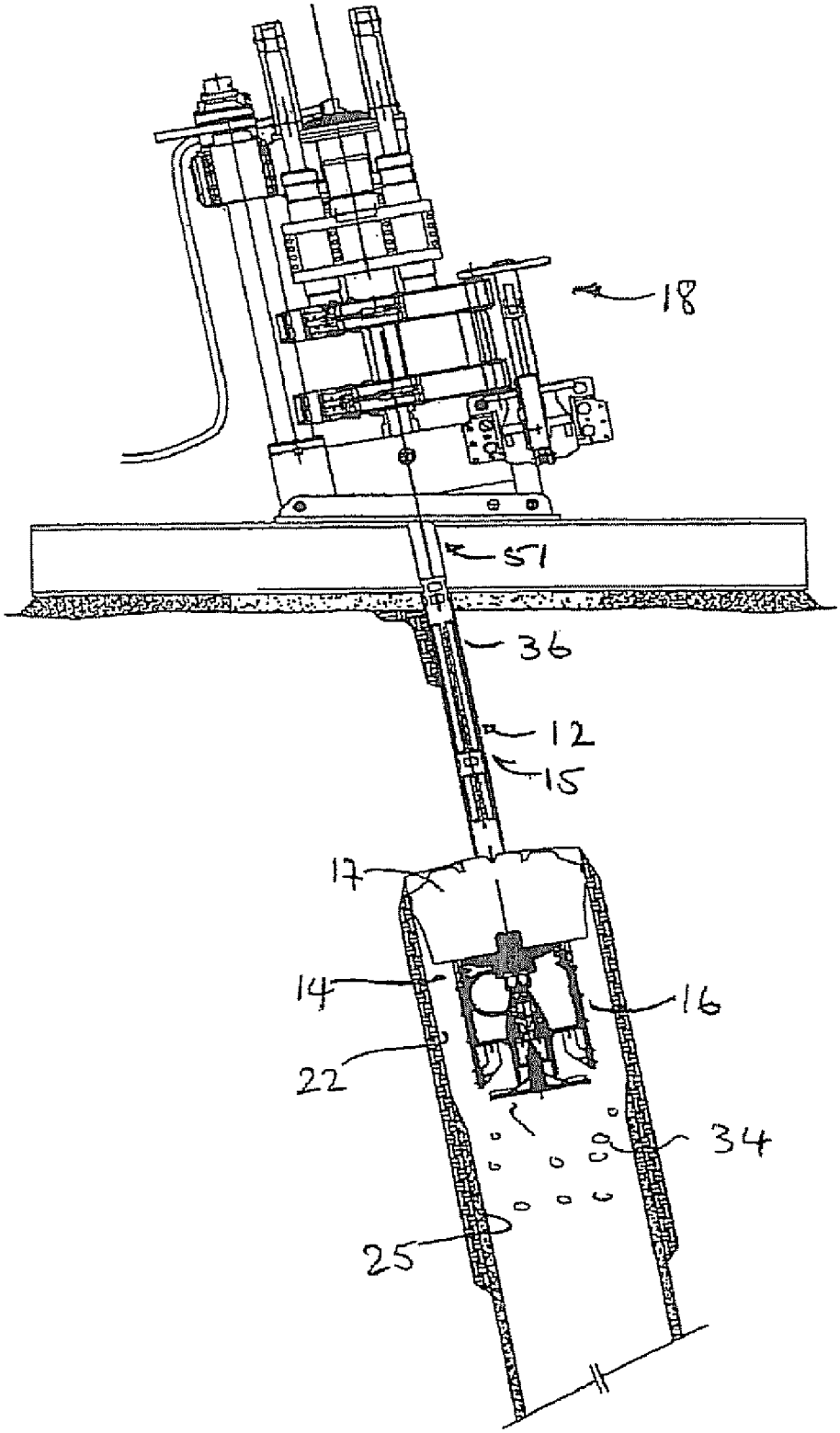
FIG. 2 is an enlarged view of a raise bore drilling and lining apparatus used in FIG. 1.

As shown in FIG. 1*a*, the apparatus 12 is initially used with a pilot drill bit to drill a pilot hole 20 from the upper gallery G1 to the lower gallery G2. During the drilling, the drill string 12 is advanced downwardly with additional lengths of drill rod 36 added as required. Upon completion of the pilot hole, the drill bit is removed and replaced with a reamer assembly 14 which is used to enlarge the pilot hole 20 to the required diameter as will be described more fully below. The details of the apparatus 10 as used with the reamer assembly 14, is shown more fully in FIG. 2.

The drill string 12 connected to reamer assembly 14 by a releasable coupling 15. The drill string 12 is also connected by a coupling 51 to a raise bore drill 18, which rotates the coupled drill string 12 and reamer assembly 14 to enlarge a pilot hole 20 for producing a bore hole 22. The reamer assembly includes a reamer 17 and a spreader assembly 16 is fastened to the bottom of the reamer 17, to provide for co-joint rotation between the reamer 17 and spreader assembly 16. The drill string 12 and reamer 14 have an internal passage 23 there-through that contains ducts for supplying drilling fluid, bore hole liner material, typically referred to as shotcrete, and a drive fluid to the spreader assembly 16. The spreader assembly 16 includes a rotating spreader wheel that is effective to apply the liner material 26 to the sides of the borehole 22.

Accordingly, as the reamer 17 is raised and rotated to enlarge the pilot hole 20, as shown in FIG. 1, the spreader assembly 16 is also raised. The reamer 17 rotates and thereby produces debris 34 and the bore hole 22. Once a section of the bore hole 22 is produced, the drill string 12 is lowered and the spreader assembly 16 rotated to direct the liner material against the side of the produced bore hole 22 for producing a lined bore hole 25.

Figure 3:
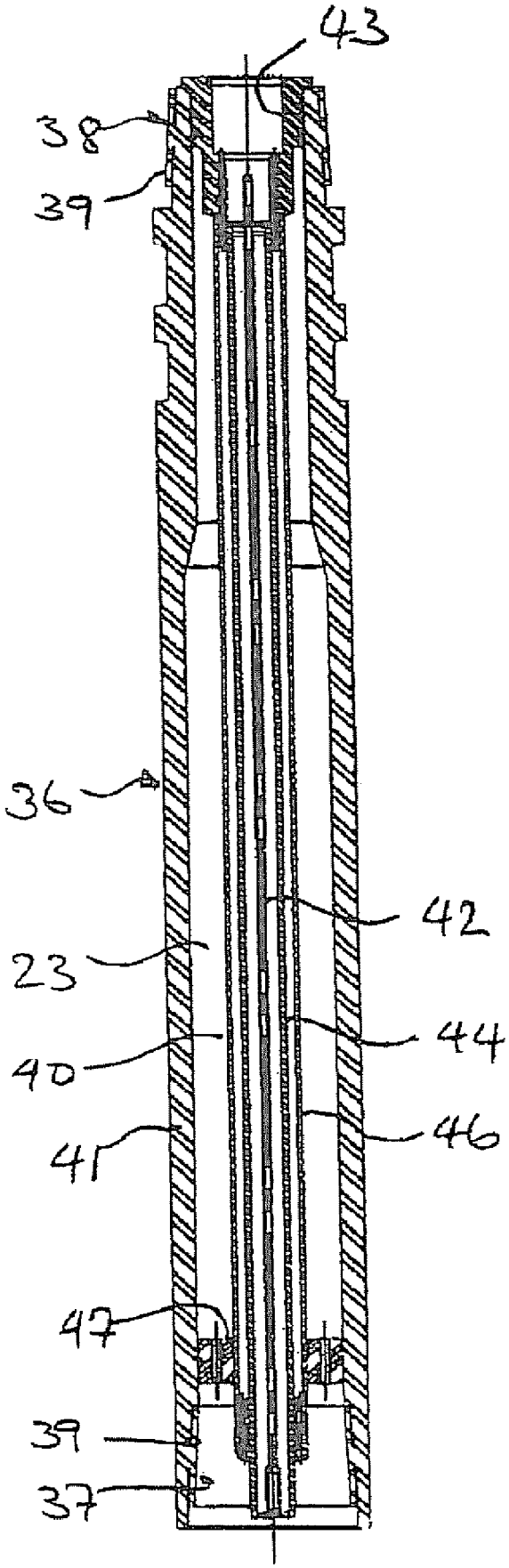
FIG. 3 is a cross-sectional view of a drill rod of the apparatus of FIG. 1.

As shown in more detail in FIG. 3, the drill string 12 of the apparatus 10 is composed of a series of connected drill rods 36, with a female coupling 37 and a male coupling 38 at opposite ends. The couplings 37, 38 have complementary threads 39 for connecting adjacent drill rods 36 to form the drill string 12 (see FIG. 1). It is recognised that the drill rods 36 could also have at either end two male couplings 38 or two female couplings 37 with suitable inserts, if desired. The drill rod 36 has an outer casing 41 within which a liner 40 is located. The liner 40 can be made of a rigid plastic material, such as but not limited to polyethylene, and defines a series of ducts for supplying the material used in the process from the raise drill 18 to the spreader assembly 16. The liner includes three concentric tubes, 42, 44, 46 that extend between a sleeve 43 at the male coupling 38 and a locating ring 47 adjacent the threaded portion 39 of the female end 37. The sleeve 43 has a radial flange 49 to locate it axially on the casing 37 and is sealed by O-rings 45 to the casing. The flange 49 is situated on top of the coupling 37 to sit on a leading edge of the threaded portion of the drill rod 36 to help prevent the liner 40 of the drill rod 36 iron being pushed through when threading the drill rods 36 together as shown in FIG. 4.

Figure 4:
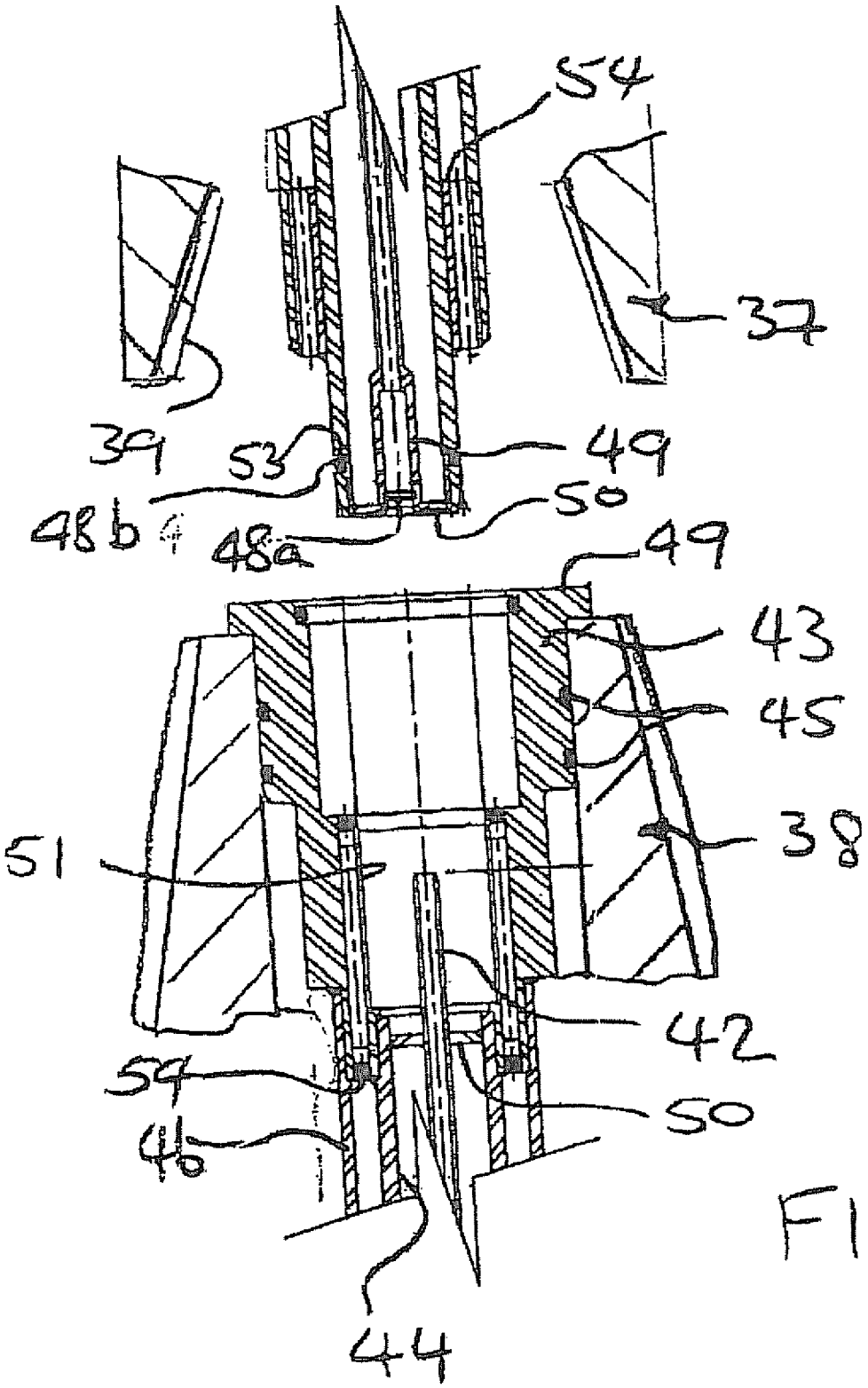
FIG. 4 is an enlarged cross-sectional view of a pair of coupled rods of FIG. 3.

Referring to FIG. 4, the alignment of adjacent drill rods 36, is shown to permit the rods 36 to be connected by mating the respective threads 39 of the female coupling 37 of rod 36 with the male coupling of the rod 36. The tube 42 has a sleeve 49 secured to it at one end with an O-ring 48*a* located within the sleeve 49. The inner diameter of sleeve 49 is dimensioned to receive the tapered upper end of the tube 42 and provide a continuous passageway across the coupling.

The tube 42 is located radially within the tube 44 by spiders 50 at opposite ends that do not impede flow along the tube 44. Tubes 44 are interconnected by a female-female fitting 51 that is secured to one end of the tube 44. The opposite end of the tube 44 has all annular groove 53 to receive an O-ring 48*b* that forms a seal between adjacent ends of tubes 44.

The tube 44 is in turn supported within the tube 46 on spaced supports 54 that permit flow across the coupling in the annulus between the tubes 44, 46. The O-ring seals 48*a,b* provide for continuity of flow in the tubes passageways 42, 44, 46 between adjacent drill rods 36*a,b*, thereby facilitating the transfer of the material and fluid from the raise drill 18 to the reamer assembly 16. It is recognised that other forms of seals 48*a,b* other than O-rings could be used for the passageways 42, 44, if desired.

Figure 5:
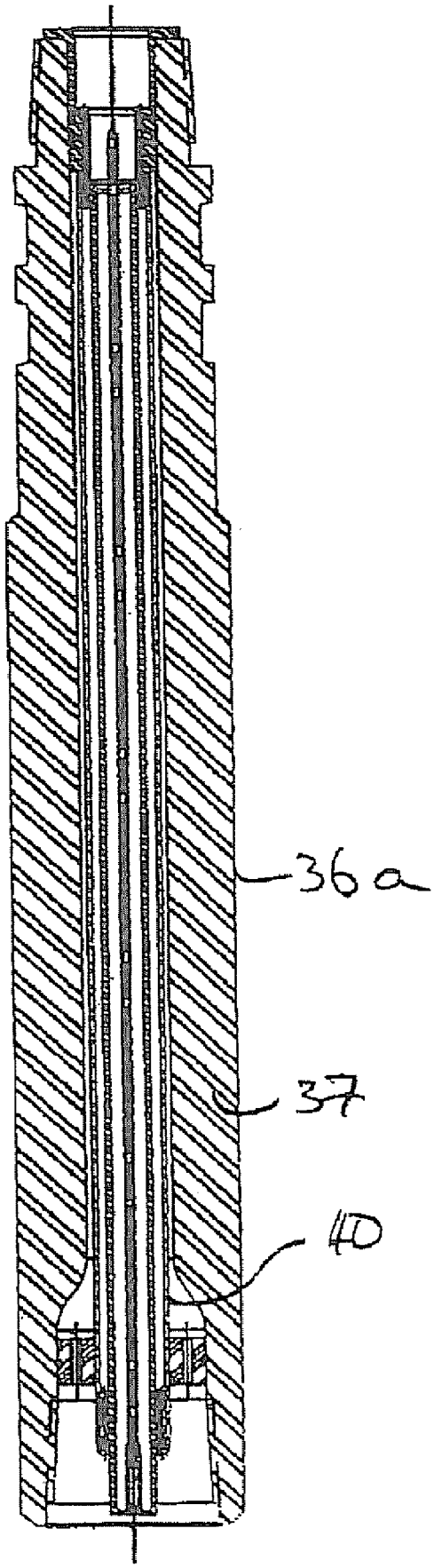
FIG. 5 is a cross-sectional view similar to FIG. 3 of an alternative embodiment of drill rod.

A particular form of rod 36 used in the body of the string 12 is shown in FIG. 4. It is conventional to use a ribbed stabilized rod, as shown in FIG. 5 periodically in the drill string 12 and the liner 40 may be incorporated within such a rod. As shown in FIG. 5, the stabilizer rod 36*a* has an internal cavity 23 to receive the liner 40 but the casing 37 has ribs providing a greater bending strength and guidance of the string 12 within the pilot bore 20.

Figure 6:
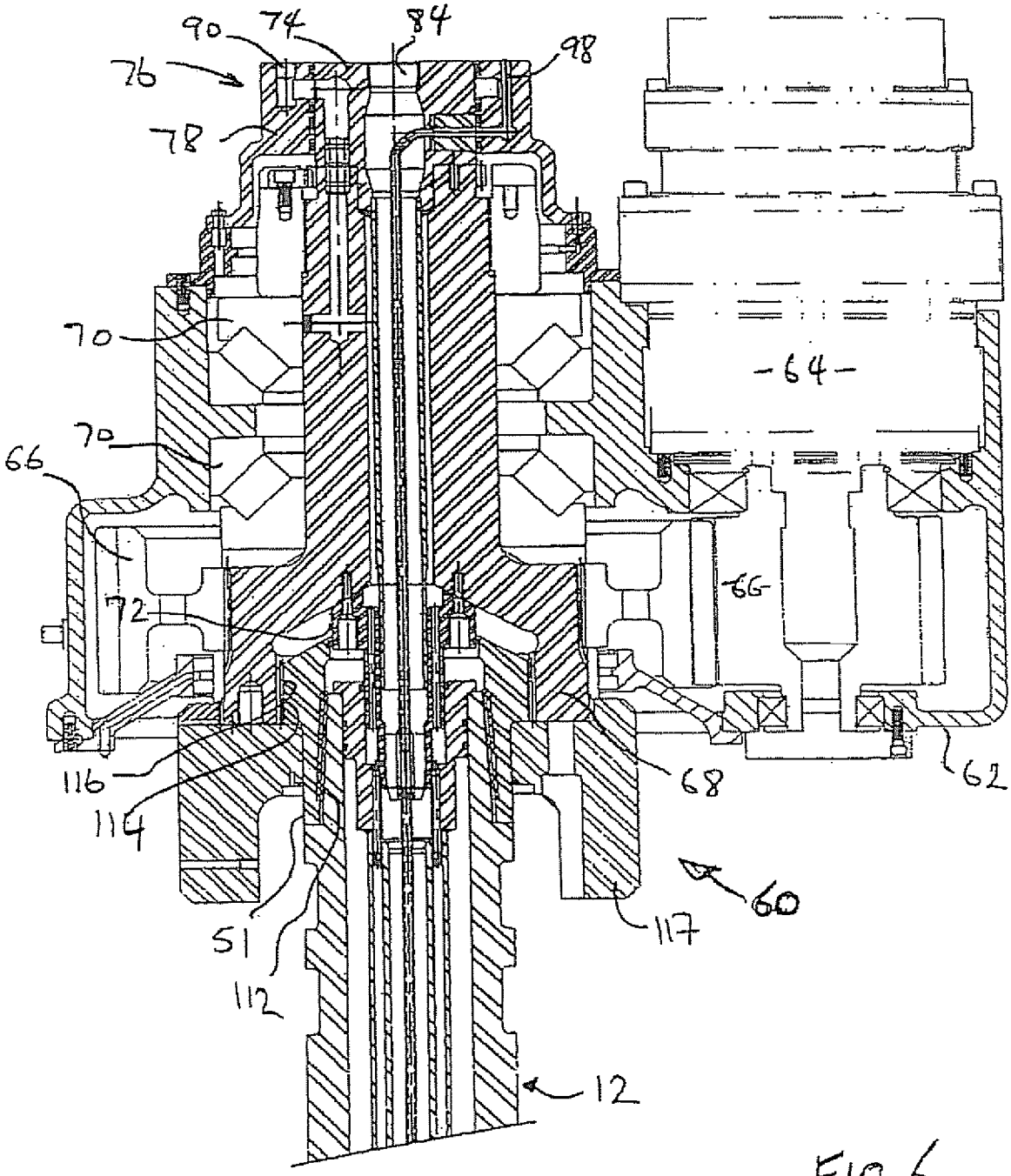
FIG. 6 is shows a sectional view of a drive arrangement of the drill string with the raise drill of FIG. 1.
Figure 7:
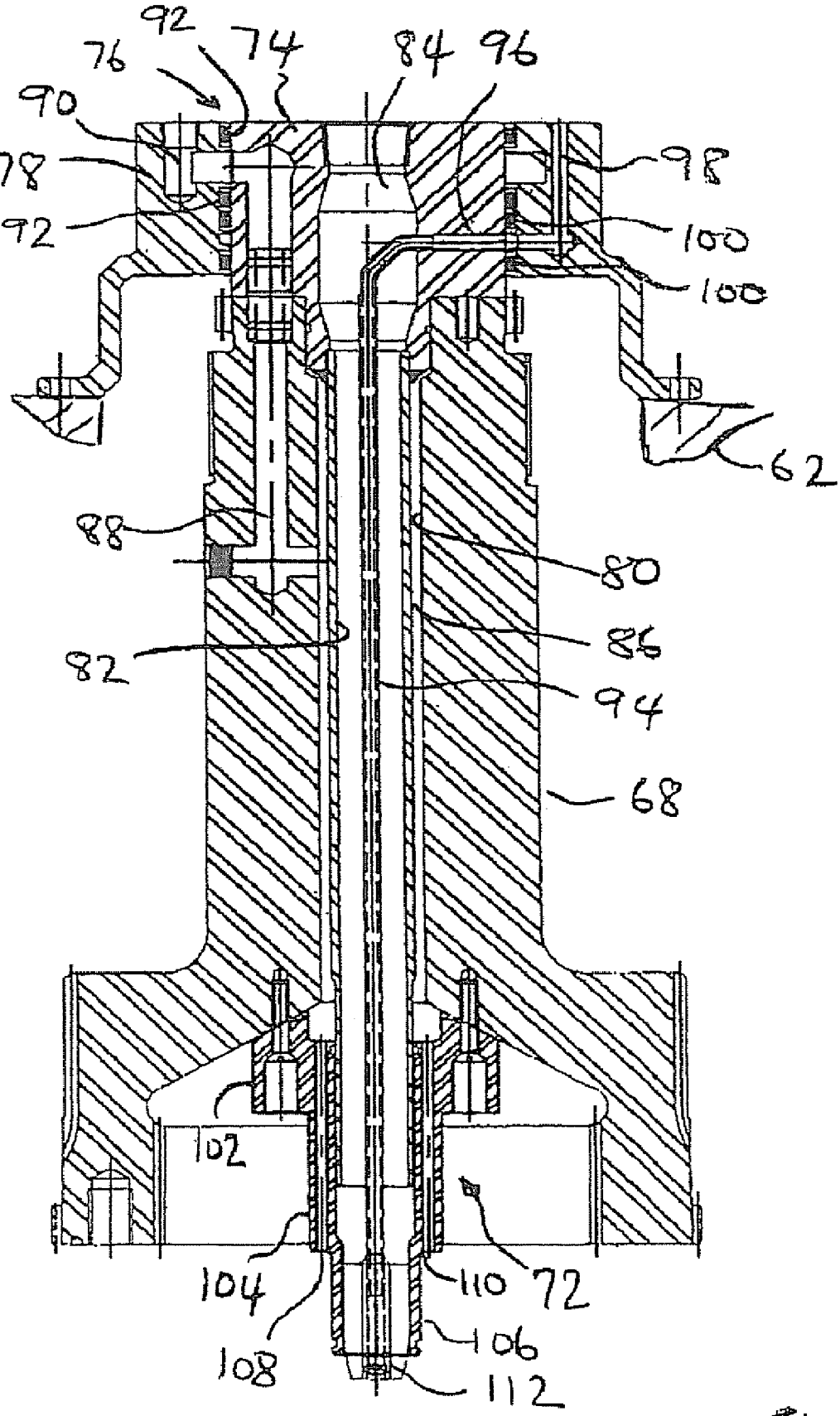
FIG. 7 is an enlarged sectional view of a component used in the drive of FIG. 6.

The tubes 42, 44, 46 are connected to respective material supplies within the drill unit 18 as shown more fully in FIGS. 6 and 7. The drill unit 18 includes a drive lead generally indicated 60 to which the drill sting 12 is connected. The drive head 60 is supported on the drill unit 18 for movement along the axis of the rod 12 in a conventional manner to allow the coupling and uncoupling of the rod 36 to the drill string 12 as required. The drive head 60 includes a support casing 62 secured to the frame of the drill unit 18. A motor 64 is located on the casing 62 and drives a gear train 66. The gear train is connected to a drive shaft 68 that extends through the casing 62 and is supported by a pair of bearings 70. An adapter 72 is bolted to the lower end of the drive shaft 68 and has a configuration corresponding to the male end 38 of a drill rod 36.

The opposite end of the drive shaft 68 is connected to a hub 74 of a rotary seal assembly 76 with a carrier stationary 78 of the seal assembly 76 secured to the casing 62. A central bore 80 extends through the drive shaft 68 and carries a tube 82. The tube 82 is connected to the hub 74 in alignment with a feed cavity 84 that is in communication with a gravity fed hopper (not shown). The tube 82 defines an outer annulus 86 between the tube 82 and bore 80 that is in communication with an internal passage 88 extending through the hub. The passage 88 is aligned with a supply passage 90 in the carrier 78. A pair of slip seals 92 are axially spaced on opposite sides of the passage 88 to permit rotation between the hub and carrier.

An inner conduit 94 extends through the tube 82 and is connected to a supply line 96 within the hub 74. The line 96 is axially aligned with a supply passage 98 in the carrier with seals 100 axially spaced on opposite sides of the passage 98 to permit relative rotation between the carrier 78 and hub 74.

The arrangement of the shaft 68 and carrier 78 permits three fluid supplies to be introduced independently through the stationary carrier 78 through passages 84, 90, and 98 for connection with the tubes 42, 44, 46, in the drill rods 36. The connection to the drill rod 36 is provided by the adaptor 72.

The adaptor 72 has a base 102 and a nose 104 projecting from the base. The outer diameter of the nose 104 is dimensioned to be a close fit within the sleeve 37 of the liner 40 and to be sealed by the O-ring 48*b*. The nose 104 has an inner cone 106 that is similarly dimensioned to fit within the female-female sleeve 53 and internal passageways 108 on a land 110 are aligned with the annulus formed between the tube 44 and tube 46.

The inner conduit 94 extends through the nose 104 and has a sleeve 112 at its lower end to receive the upper end of tube 42. There is thus a fluid connection through the carder 78 to the passageways in the liner 40.

The drill rod 36 is secured to the shaft 68 by means of the coupler 51. The coupler 51 has a female threaded portion 112 to receive the male threaded end of the rod 36 and an outer spline 114 that is received in an internal socket 116 on the shaft 68. The coupling 51 is secured by a retainer ring 117 and permits limited axial float relative to the drive shaft for secure connection of the adaptor 72 to the rod 36. It will be apparent that as the drive shaft 68 is rotated by the motor 64, the torque is transmitted to the rod 36 through the coupling 51. The tubes within the shaft 68 rotate with it and switch the slip coupling between the carrier 78 and hub 74 allowing the transfer of fluids between the stationary and rotating portions.

Figure 8:
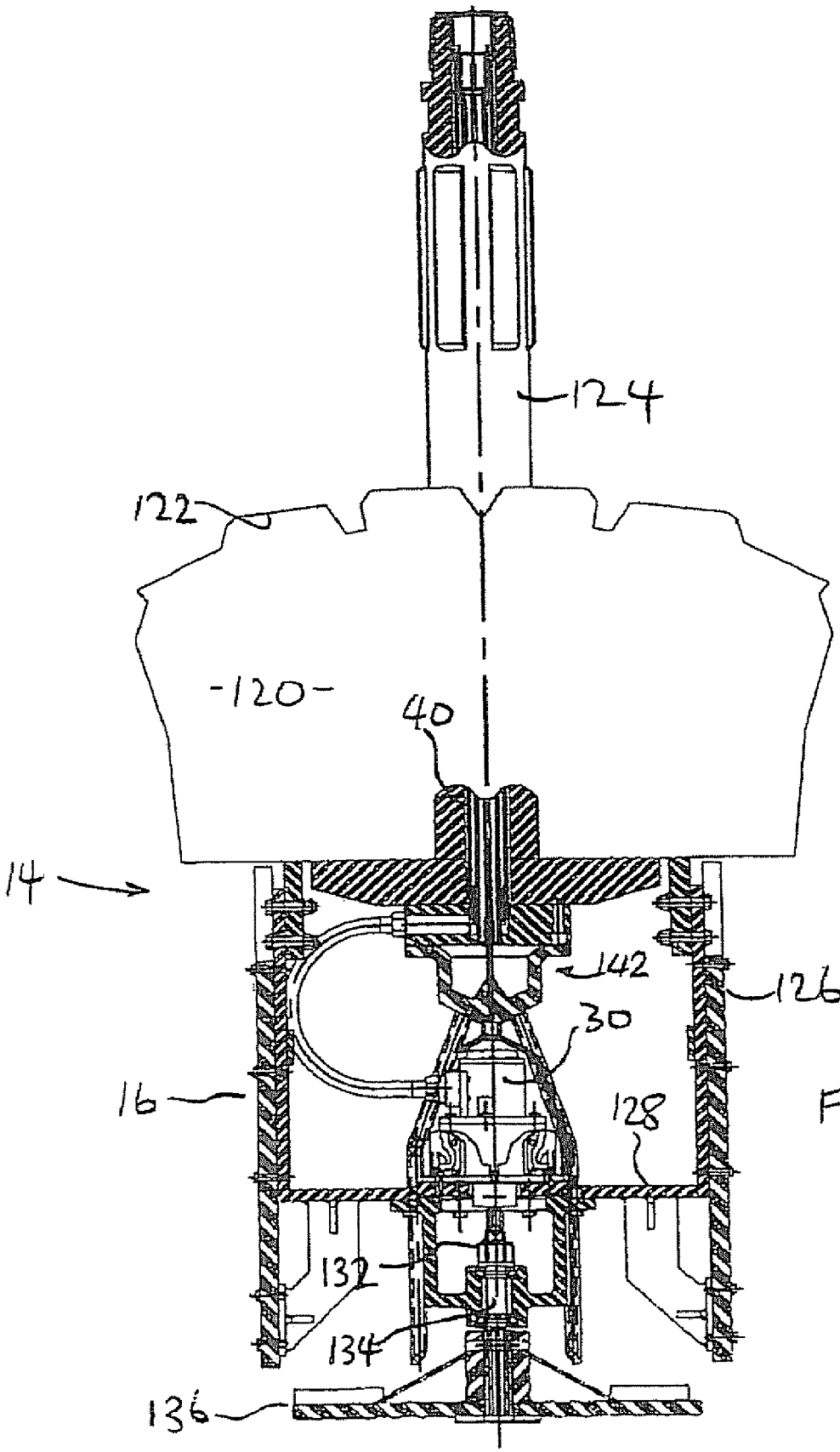
FIG. 8 is a side view of a reamer assembly.
Figure 9:
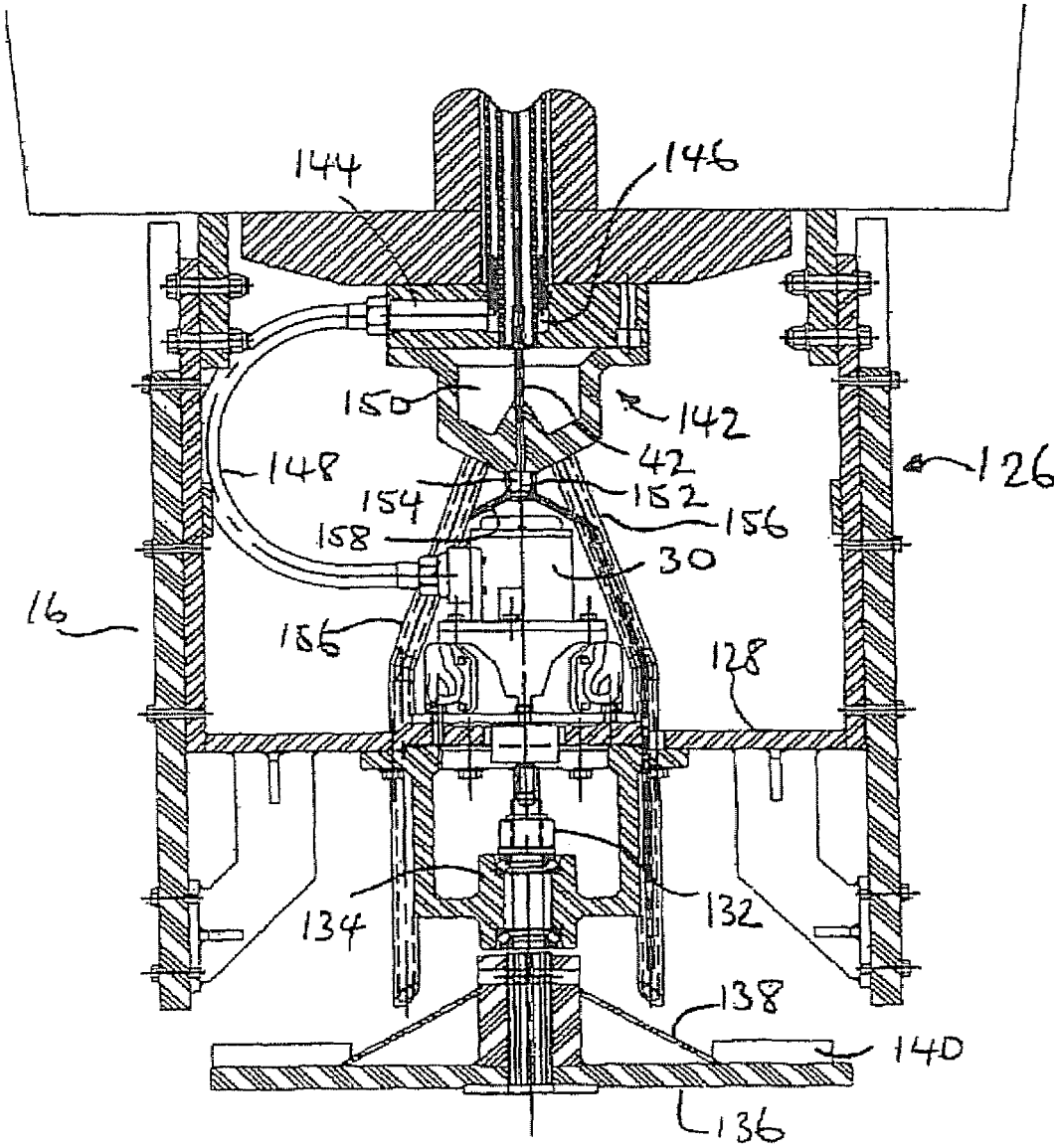
FIG. 9 is a sectional view on an enlarged scale of the reamer assembly of FIG. 8.

A tool 13 is connected at the opposite end of the drill string 12 and may either be a conventional drill bit for drilling the pilot hole or a reamer assembly 14 as shown in FIGS. 8 and 9.

Referring firstly to FIG. 8, the reamer assembly 14 has a main body 120 equipped with cutting teeth 122 with a drive shaft 124 extending from the body 120. The drive shift 124 is configured to be connected to the lower end of a drive rod 36, typically the stabilizer drive rod 36*a* and includes an internal liner 40 corresponding functionally to the liner 40 found in the drill rods 36. A spreader assembly 16 is secured to the underside of the body 120.

The spreader assembly 16 includes an outer housing 126 depending from the underside of the body 120 with a mounting plate 128 spaced from the underside of the body 120. The fluid motor 30 is supported on the plate 128 with a drive shaft 132 connected to the motor 30 and, supported in a bearing 134. The shaft 132 extends through the bearing 134 aid is connected to a spinner plate 136. The spinner plate 136 has a frusto-conical shield 138 extending inwardly and upwardly toward the body 120 with fins 140 spaced circumferentially around the periphery of the plate 136. The motor 130 is operable to rotate the plate 128 relative to the body 120 and impart a radial force on material deposited on the plate. The fins may be linear or, preferably curved rearwardly, to assist in the radial flow of material.

A terminal block 142 is located within the housing 142 to separate the fluid flows delivered through the liner 40. The terminal block 142 has a radial passage 144 that extends into a central cavity 146. The tube 46 terminates within the cavity 146 with the tube 44 extending across the cavity to be sealed within the block 142. Accordingly, fluid in the annulus between the tubes 44 and 46 flows through the radial passage 144 and is conveyed by flexible pipe 148 to the motor 30. A primary reservoir 150 is formed within an end cap 152 of the terminal block 142 and the tube 44 opens into the reservoir 150. The tube 42 extends through the reservoir 150 into a secondary reservoir 154 so that fluid supplied through the tube 44 is received in the reservoir 150 and fluid supplied through the tube 42 is received in the reservoir 154.

A set of transfer pipes 156 are connected to the primary reservoir 150 and extend downwardly past the motor 30 to terminal adjacent the shield 138. Typically, four transfer pipes 156 are provided although, it will of course be appreciated that more or less transfer pipes may be used according to particular design constraints. A second set of transfer pipes 158 are connected to the secondary reservoir 154 and terminate adjacent the termination of the transfer pipes 156. The supply of fluid to the tubes 42, 44, 46 through the hub 74 is determined according to the mode of operation of the apparatus 12.

In operation of the apparatus 10, during drilling of the pilot hole 20, drilling fluid is supplied to the cavity 84 and bore 80 in the hub 74 and is directed through the tube 82 and into the tube 44. The drilling fluid is thus delivered to the drill bit for flushing and returned to the drill unit 18 around the casing 37 in the normal manner. Once the pilot hole 20 has been made, pilot drill bit (not shown) and roller stabilizers (if used) are removed and the reamer 17 is affixed to the lower end of the drill string 12 while in the pilot hole 20. The reamer 17 is then placed at the bottom of the pilot hole 20 adjacent to the rock face. The spreader wheel assembly 16 is now connected to the underside of the reamer head 17, and reaming begins as the raise drill 18 rotates the drive shaft 58 and simultaneously the coupled drill string 12 and reamer bead 14. Teeth 122 on the reamer head 17 cut into the rock-c face and expand the pilot hole 20 to the larger diameter of bore hole 22. After a certain distance, reaming is halted, the reaming assembly 14 is lowered. A supply of shotcrete is connected to the tube 82 and shotcrete is pumped through the tube 44 into the reservoir 150. Simultaneously, the passage 88 is connected to a supply of additive, such as an accelerator, for supply through the tube 42 to the secondary reservoir 154. A source of compressed air is connected to passage 98 which is supplied through the tube 46 to the motor 30. The supply of compressed air or other drive fluid, causes the plate 136 to rotate. Shotcrete and accelerator is delivered by respective transfer pipes 156, 158 to the spinning plate 136 which sprays shotcrete onto the recently created bore hole 22 wall to produce the lined bore hole 25. As the plate 136 rotates, the coupled reamer assembly is raised at a predetermined rate to apply a specified thickness of shotcrete to the wall of the bore hole 22. The proximity of the delivery of accelerator to the shotcrete facilitates rapid solidification of the lining.

When the reamer assembly 14 is again flush with the rock face of the top of the borehole 22, pumping of shotcrete is halted, and water is then pumped through the tube 44 in the rod 36. The spreader assembly 16 and the passageway 42 are thus flushed clean with water. It should be noted the shotcrete on the bore hole wall 26 should be sufficiently set before flushing the spreader assembly. The reamer head 14 is then raised to contact the rock face, and reaming is continued. The sequential process of reaming and lining is repeated until the lined bore hole 25 is completed. As the reamer head 14 is raised by each drill rod 36 length, the drill string 12 is wrenched in order to remove the topmost drill rod 36 and then the reaming process is continued.

It is noted that prior to set up of the reamer head 14 and drill string 12 to the raised drill 18, the drill rods 36 and reamer core are lined with the liner 40. The liner 40 can also fit reasonably tight inside the passage 23 of the drill rod 36 to help prevent the liner 40 falling out during transport. Further, the combined liner 40 and drilling apparatus 10 helps to reduce the amount of equipment required and thereby facilitates a reduction in time in the creation of a borehole 22. This system 10 enables reinforcement to be provided to the wall of the borehole 72 immediately behind the reamer head 14.

It will also be appreciated that during the lining process the reamer may rotate or be stationary. The motor 30 provides independent rotation of the plate 136 at a higher rate than usually associated with the reamer, thereby facilitating depositing of the shotcrete on the borehole 22 to form the liner.

Although the invention has been described with reference to certain specific embodiments, various modifications thereof will be apparent to those skilled in the art without departing from the spirit and scope of the invention as outlined in the claims appended hereto,

What is claimed is:

1. A reamer assembly for use with a raise bore drilling and lining apparatus, said reamer assembly including a reamer head, a spreader assembly secured to said reamer head for movement therewith and for distributing a liner material on the wall of said bore hole during operation thereof, said spreader assembly comprising a plate rotatable relative to said reamer head; and a material supply connected to said spreader assembly to deliver material thereto.

2. A reamer assembly according to claim 1 including a motor for rotating said plate.

3. A reamer assembly according to claim 1 wherein said motor is fluid driven.

4. A reamer assembly according to claim 1 including a material reservoir and supply pipes extending from said reservoir to deliver material to said plate.

5. A reamer assembly according to claim 4 including a pair of reservoirs, each having respective supply pipes.

6. A reamer assembly according to claim 1 wherein said reamer assembly is connected to a drill string, said drill string including a plurality of drill rods connected in seriatim, wherein each of said plurality of drill rods includes an outer casing and a liner located within said casing, said liner having a plurality of concentric walls defining a series of fluid passageways between successive ones of said walls to convey fluid axially within said rod between opposite ends.

7. A reamer assembly for use with a raise bore drilling and lining apparatus, said reamer assembly including a reamer head; a spreader assembly secured to said reamer head for movement therewith and for distributing a liner material on the wall of said bore hole during operation thereof, said spreader assembly independently rotatable of said reamer head; and a material supply connected to said spreader assembly to deliver material thereto.

8. A reamer assembly according to claim 7 wherein said spreader assembly includes a plate rotatable relative to said reamer head to dispense said material.

9. A reamer assembly according to claim 7 including a motor for rotating said plate.

10. A reamer assembly according to claim 7 wherein said motor is fluid driven.

11. A reamer assembly according to claim 7 including a material reservoir and supply pipes extending from said reservoir to deliver material to said plate.

12. A reamer assembly according to claim 11 including a pair of reservoirs, each having respective supply pipes.

13. A reamer assembly according to claim 7 wherein said reamer assembly is connected to a drill string, said drill string including a plurality of drill rods connected in seriatim, wherein each of said plurality of drill rods includes an outer casing and a liner located within said casing, said liner having a plurality of concentric walls defining a series of fluid passageways between successive ones of said walls to convey fluid axially within said rod between opposite ends.

* * * * *